United States Patent [19]

LeMert

[11] Patent Number: 4,526,083

[45] Date of Patent: Jul. 2, 1985

[54] CYMBAL MOUNTING FIXTURE

[76] Inventor: Alfred J. LeMert, 5565 Bolla Ct. SW., Ft. Myers, Fla. 33907

[21] Appl. No.: 628,526

[22] Filed: Jul. 6, 1984

[51] Int. Cl.[3] ..... G10G 5/00

[52] U.S. Cl. ..... 84/421; 84/422 R; 403/220

[58] Field of Search ..... 84/421, 422; 248/560, 248/634; 403/220, 224

[56] References Cited

U.S. PATENT DOCUMENTS

| | | | |
|---|---|---|---|
| 4,200,024 | 4/1980 | Watson | 84/421 |
| 4,216,695 | 8/1980 | Hoshino | 84/421 |
| 4,365,535 | 12/1982 | Buttner et al. | 84/421 |
| 4,381,690 | 5/1983 | Kimble | 84/422 R |
| 4,458,574 | 7/1984 | Hoshino | 84/422 R |

*Primary Examiner*—Lawrence R. Franklin
*Attorney, Agent, or Firm*—Merrill N. Johnson

[57] ABSTRACT

Apparatus for mounting a cymbal on the threaded end of a cymbal stand. A cylindrical fitting made of resilient material having embedded in its lower end an internally threaded plug adapted to fit onto the threaded end of the cymbal stand and having at its upper end an externally threaded shaft. A shouldered plastic washer designed to fit snugly around the fitting's threaded shaft, the shoulder of the washer sized to fit within the hole in the cymbal to be mounted on the cymbal stand. A knob having an internally threaded hole and a substantially flat lower face surrounding the hole designed to be screwed down upon the shaft of the fitting.

6 Claims, 4 Drawing Figures

CYMBAL MOUNTING FIXTURE

BACKGROUND AND SUMMARY OF THE INVENTION

The present invention relates to apparatus for mounting a musical cymbal onto a conventional cymbal stand.

The cymbals used by drummers in most orchestras and bands are conventionally mounted on a cymbal stand beside the bass drum and other instruments played by the drummer. The upper end of the cymbal stand which end usually is vertical but which may be tilted or even horizontal is a threaded cylindrical shaft onto which the brass cymbal is mounted by a hole in the center of the cymbal.

Conventionally a metal washer is fitted over the threaded end of the shaft resting on the upper shoulder of the unthreaded portion of the shaft and then a cylindrical plastic sleeve is fitted over the lower end of the threaded portion of the shaft. A felt washer is then slipped over the plastic sleeve, followed by the cymbal which has a circular hole in its center. A second felt washer is then usually placed over the cymbal and a wing nut screwed down upon the upper felt washer to hold the cymbal onto the cymbal stand.

This conventional means of mounting the cymbal on the cymbal stand has proven generally unsatisfactory. While providing some protection of the cymbal, the felt washers tend to dampen the vibration of the cymbal, and, more important, the hole in the cymbal is not snugly secured by the plastic sleeve and felt washers and cracks or ruptures often appear in the body of the cymbal adjacent its central hole resulting in failure of the cymbal to produce its intended sounds.

It has also been proposed to mount the cymbal on a fixture which is connected to the cymbal stand by one or more flexible helical coiled springs. While this arrangement has some advantage over the above described conventional arrangement, springs have a tendency to squeak and such noises are most undesirable in a band or orchestra. Moreover, the plastic sleeve and felt washers at the upper end of the coiled helical spring are still subject to the same disadvantage of slippage of the cymbal, damping of the vibration of the cymbal and failure to securely seat the cymbal to prevent rupture or cracking around the hole in the cymbal.

Accordingly I have invented a unique mounting for a cymbal which protects the cymbal against cracking and breakage, is completely free of unwanted background noises from either movement of the cymbal against its mounting or by any moving part, permits the cymbal to be played at any mounting angle, extends the life of the cymbal and requires no lubrication of a spring or any other moving parts.

Basically, my cymbal mounting consists of four major components: a machine nut threaded to fit onto the threaded upper end of the cymbal stand; a cylindrical fitting made preferably of cast or molded rubber which is screwed onto the threaded upper end of the cymbal stand to rest firmly against the nut and includes an upwardly projecting threaded shaft; a washer with an annular shoulder sized to fit snugly within the hole of a cymbal and which sits on the upper face of the cylindrical fitting; and an internally threaded knob adapted to be screwed onto the threaded shaft of the fitting after the cymbal has been placed onto the shouldered washer.

Prior to threading the knob onto the threaded shaft of the fitting, it may first be desirable to place a flexible washer preferably made of rubber or similar resilient material over the end of the fitting's shaft to rest on top of the cymbal. In either event the knob is then hand tightened against the flexible shouldered washer or against the upper surface of the cymbal itself.

DETAILED DESCRIPTION OF THE PREFERRED EMBODIMENT

Figure 1:
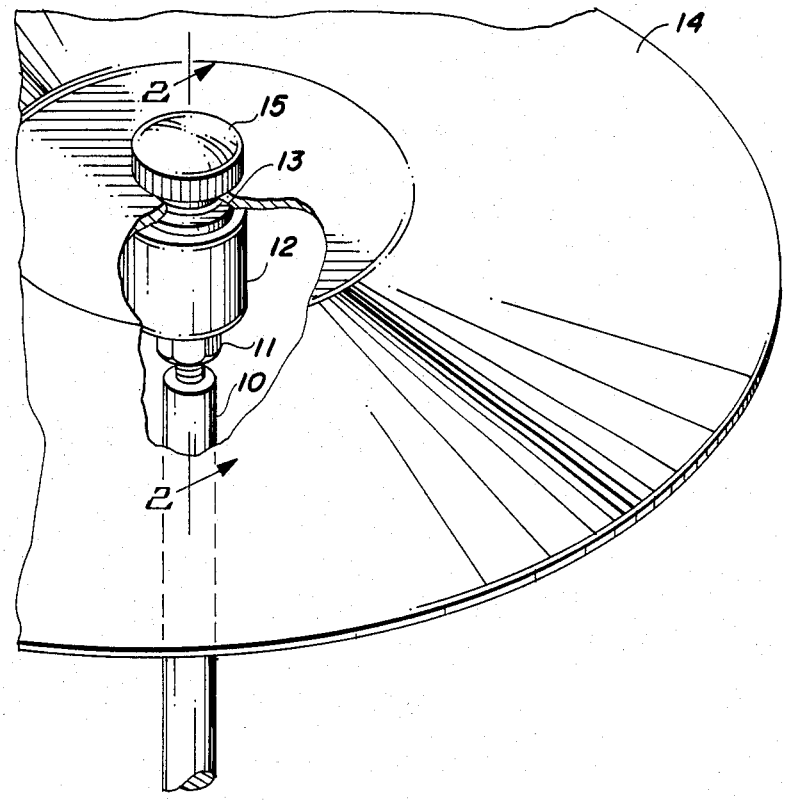
FIG. 1 is a partially broken away perspective view of a preferred embodiment of my unique apparatus for mounting a cymbal on a cymbal stand.
Figure 2:
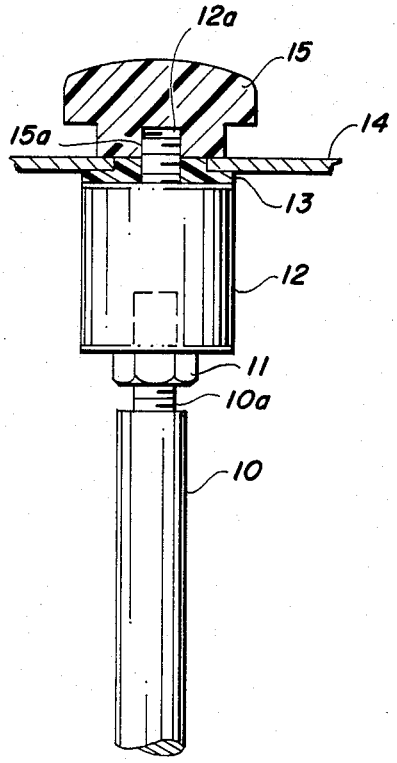
FIG. 2 is a side view partially broken away of a cymbal mounted in accordance with my invention taken along line 2—2 of FIG. 1.
Figure 3:
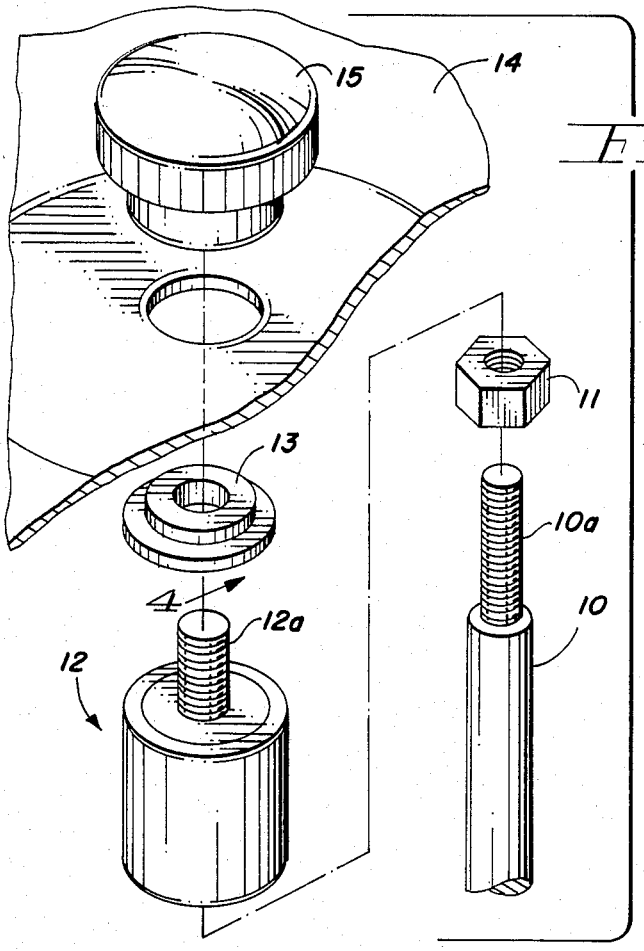
FIG. 3 is an exploded perspective view partially broken away of the cymbal mounted on a cymbal stand with my invention as shown in FIG. 1.

Referring now to FIGS. 1–3, there is shown the upper shaft 10 of a cymbal stand which conventionally has a threaded end 10*a*. Cymbal stands made in America conventionally have a one quarter inch shaft with an American thread having 20 threads to the inch. Cymbal stands produced abroad are conventionally threaded with a six millimeter metric thread. My apparatus is made with fittings which can be mounted on both the American threaded cymbal stands as well as the metric threaded cymbal stands. This requires two different sets of apparatus as will be explained more fully hereinafter.

To mount the cymbal in accordance with my invention, the conventional plastic sleeve surrounding the threaded upper end 10*a* of cymbal stand 10, the meter washer and two felt washers and wing nut conventionally used are removed from the cymbal stand.

Then a preferably hexagonal machine nut 11 threaded to fit on either the American or metric thread of the particular cymbal stand 10 being used is first screwed onto threaded upper end 10*a* of the cymbal stand. Nut 11 is followed by threading onto the cymbal stand a cylindrical fitting 12 which is screwed down to rest securely against machine nut 11 as in FIG. 2.

Figure 4:
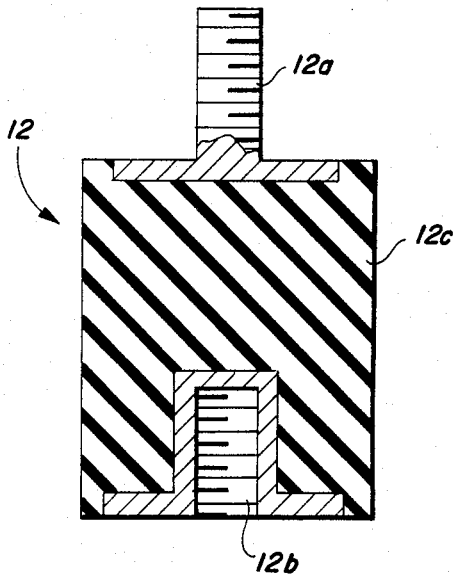
FIG. 4 is a cross-sectional view of the cylindrical fitting shown in FIGS. 1 through 3.

As best shown in FIG. 4, fitting 12 consists of three principal parts, namely, a cylindrical body 12*c* molded or cast of vulcanized rubber or neoprene or similar resilient material into which are embedded two preferably metal members, shaft 12*a* and plug 12*b*. Shaft 12*a* has an externally threaded cylindrical shaft with a cylindrical flange at one end which flange is firmly embedded into the upper face of fitting body 12*c*. Plug 12*b* consists of an internally threaded cylindrical plug with a cylindrical flange at one end, which plug is fully embedded in the lower end of body 12*c* with the lower face of the flange portion of plug 12*b* flush with the lower face of body 12*c*. Plug 12*b* is threaded with either the American thread or metric thread of the cymbal stand so that it will properly screw onto the upper end 10*a* of the cymbal stand.

A shouldered washer 13 is next placed over the threaded shaft 12*a* of fitting 12. Washer 13 is preferably made of nylon, polyethylene or other high density plastic material and includes an annular upper shoulder best shown in FIG. 3. The outer diameter of washer 13 is three quarters of an inch and the diameter of the hole in the center of the washer is one quarter of an inch. The outer diameter of the annular shoulder of washer 13 is one half inch and the thickness of the washer at its outer diameter is one sixteenth of an inch and the thickness of the annular shoulder of the washer is also one sixteenth of an inch.

The circular hole in the center of almost all cymbals has a diameter slightly over one half inch and a depth of about one sixteenth of an inch. Thus the cymbal placed upon washer 13 will fit snugly around the shoulder of washer 13 with no possibility of slippage or movement of the cymbal in relation to the washer or the upper shaft 12*a* of fitting 12. After cymbal 14 is seated onto washer 13, it may be desirable to place a flexible washer made of rubber, felt or other suitable material onto the shaft 12*a* over cymbal 14. This washer is not, however, shown in the drawings as such washers are in common use with other means for mounting cymbals. Either with or without such a washer resting on the upper surface of the cymbal, an internally threaded knob 15 is screwed down upon shaft 12*a* until the lower surface of knob 15 is firmly resting against either the flexible washer not shown or the upper surface of cymbal 14 itself.

Knob 15 is preferably made of Delrin or similar high density plastic material and includes an axially interiorly threaded hole 15*a* which may be either cut directly onto the plastic material of knob 15 itself or a brass or other metal insert which is threaded to screw onto threaded shaft 12*a* of fitting 12. Preferably the annular outer edge of knob 15 is knurled to accommodate easy threading of the knob onto shaft 12*a* and proper tightening of the lower face of the knob against the flexible washer or the upper surface of cymbal 14 as desired by the drummer. For best results, the knob is hand tightened only with no use of pliers or wrenches.

Except for the dimensions previously set forth for shoulder washer 13 and the threading of machine nut 11 and plug 12*b*, the dimensions of the remaining components of my invention are not particularly critical. However, I have found that excellent results are obtained when the outer diameter of fixture 12, that is the outer diameter of its body 12*c*, is approximately one inch and the height of body 12*c* is also approximately one inch. The diameter of the knurled outer edge of knob 15 is approximately one and one quarter inches and the outer diameter of the lower face of knob 15 which bears against either a flexible washer or the upper surface of the cymbal is approximately three quarters of an inch.

When a flexible washer is inserted between the upper face of cymbal 14 and the lower face of knob 15 the washer is preferably three quarters of an inch in diameter and approximately one eighth of an inch thick.

While I have shown in the drawings and described a preferred form of my unique apparatus for mounting a cymbal on a cymbal stand, changes in dimensions and modification of one or more of the components of my apparatus will be readily apparent to those skilled in the art. It is not intended that the drawings and foregoing description in any way limit my invention whose spirit and scope are defined only by the following claims.

I claim:

1. Apparatus for mounting a cymbal on the threaded end of a cymbal stand comprising:

a fitting having a generally cylindrical body of resilient material into one end of which is embedded an axial plug, said plug being internally threaded to fit onto the threaded end of a cymbal stand, and onto the opposite end of which fitting is attached and externally threaded shaft, a shouldered washer designed to fit snugly about the shaft of said fitting, the shoulder of said washer having an outer diameter of approximately one half inch and a thickness of approximately one sixteenth of an inch, and a knob having an internally threaded hole and a generally flat lower face surrounding said threaded hole designed to be screwed down upon the shaft of said fitting.

2. Apparatus for mounting a cymbal on a cymbal stand as set forth in claim 1 in which the body of the fitting is made of rubber and has heighth of approximately one inch and an outer diameter of approximately one inch.

3. Apparatus for mounting a cymbal on a cymbal stand as set forth in claim 1 or 2 in which the shouldered washer is made of high density thermoplastic materal.

4. Apparatus for mounting a cymbal on the threaded end of a cymbal stand comprising:

a fitting having a cylindrical body of neoprene rubber into one end of which is embedded an axial plug, said plug being internally threaded to fit onto the threaded end of a cymbal stand, an externally threaded shaft is firmly attached to the opposite end of said cylindrical body, a shouldered washer designed to fit closely about the shaft of said fitting, the shoulder of said washer having an outer diameter of one half inch and a thickness of one sixteenth of an inch, and a knob having an internally threaded hole and a flat lower face surrounding said threaded hole designed to be screwed down upon the shaft of said fitting.

5. Apparatus for mounting a cymbal on a cymbal stand as set forth in claim 4 in which the body of the fitting has a heighth of approximately one inch and an outer diameter of approximately one inch.

6. Apparatus for mounting a cymbal on a cymbal stand as set forth in claim 4 or 5 in which the shouldered washer is made of polyethylene.

* * * * *